US006055952A

United States Patent [19]

Gau

[11] Patent Number: 6,055,952

[45] Date of Patent: May 2, 2000

[54] AUTOMATIC DECOMPRESSION DEVICE

[75] Inventor: Tien-Ho Gau, Hsinchu, Taiwan

[73] Assignee: Industrial Technology Research Institute, Taiwan

[21] Appl. No.: 09/093,071

[22] Filed: Jun. 8, 1998

[51] Int. Cl.[7] ..... F01L 13/08

[52] U.S. Cl. ..... 123/182.1; 123/90.16

[58] Field of Search ..... 123/182.1, 90.16, 123/90.17

[56] References Cited

U.S. PATENT DOCUMENTS

| | | | |
|---|---|---|---|
| 3,395,689 | 8/1968 | Kruse | 123/182.1 |
| 3,511,219 | 5/1970 | Esty | 123/182.1 |
| 3,620,203 | 11/1971 | Harkness | 123/182.1 |
| 3,897,768 | 8/1975 | Thiel | 123/182.1 |
| 3,901,199 | 8/1975 | Smith | 123/182.1 |
| 3,981,289 | 9/1976 | Harkness | 123/182.1 |
| 4,672,930 | 6/1987 | Sumi | 123/182.1 |
| 4,696,266 | 9/1987 | Harada | 123/182.1 |
| 4,892,068 | 1/1990 | Coughlin | 123/182.1 |
| 4,898,133 | 2/1990 | Bader | 123/182.1 |
| 5,711,264 | 1/1998 | Jezek et al. | 123/182.1 |

FOREIGN PATENT DOCUMENTS

| | | | |
|---|---|---|---|
| 0167691 | 1/1986 | European Pat. Off. | 123/182.1 |

*Primary Examiner*—Noah P. Kamen
*Assistant Examiner*—Hai Huynh
*Attorney, Agent, or Firm*—Pillsbury Madison & Sutro LLP

[57] ABSTRACT

An automatic decompression device for four-stroke engines comprises a cam gear, a counterweight, and an acting body. The cam gear includes a cam surface and a recess containing the acting body, and the counterweight includes a plate with a guide slot. Besides, the recess pierces the cam surface. Since the acting body is engaged to the guide slot of the counterweight and there exist external forces acting on the counterweight, the counterweight is forced to move the acting body upwardly or downwards by the guidance of the plate and the limitation of the guide slot. Consequently, the acting body is exposed beyond the cam surface or tucked into the recess. With the motion of the acting body, the opening and closing duty cycles of the intake and exhaust valves are biased. When the engine of the invention is static, the acting body is exposed beyond the cam surface to partially release the pressure of the engine's combustion chamber for manually starting the engine. When the engine of the invention is rotated at a relatively high speed, the acting body is tucked into the recess to make the engine's intake and exhaust valves working normally.

13 Claims, 8 Drawing Sheets

AUTOMATIC DECOMPRESSION DEVICE

FIELD OF THE INVENTION

The invention relates to an automatic decompression device for four-stroke engines.

BACKGROUND OF THE INVENTION

Decompression devices had been used in small engines before 1978. The objective of the decompression device of an engine is to control the opening and closing periods of intake and exhaust valves as the engine is operated at different engine speed. With the decompression device, the pressure of the engine's combustion chamber is partially released to make manually starting the engine up easily achievable.

Please refer to FIG. 1, which is the exploded perspective view of an automatic decompression device for four-stroke engines of the prior art, which the automatic decompression device 10 comprises a cam gear 11, a counterweight 12, a rotation device 13, a plate cover 14, and a spring 15. A cam surface 111 on the upper side of the cam gear 11 has a recess 111. The counterweight 12 has a guide slot 121 at its one side, and, at the other side, the counterweight 12 and the spring 15 are connected. The rotation device 13 includes a half cylinder 131 on its upper right side and a pin 132 on its lower left side. The half cylinder 131 has a circular surface 133 and a groove 134. The recess 112 contains the half cylinder 131 of the rotation device 13. The pin 132 is projected perpendicularly outwardly from the bottom side of the cam gear 11 and guided by the guide slot 121 of the counterweight 12. The counterweight 12, the rotation device 13, and the spring 15 are pressed between the cam gear 11 and the plate cover 14.

Before the engine is started up, since the spring forces induced by the spring 15 act on the counterweight 12, the circular surface 133 of the half cylinder 13 is projected radially outwardly from the cam surface 111 through the recess 112. As the engine is started up and its speed grows up, the centrifugal forces generated by rotation act on the counterweight 12 against the spring forces induced by the spring 15 to move the counterweight 12 radially outwardly, and the rotation device 13 is thus rotated by the counterweight 12 because the pin 132 of the rotation device 13 is guided by the guide slot 121 of the counterweight 12. At this time, the groove 134 of the half cylinder 131 is rotated to face to the outside of the cam gear 11, and the circular surface 133 is consequently rotated to face to the inside of the cam gear 11. In other words, the half cylinder 131 is not projected outwardly from the cam surface 111 through the recess 112.

Please refer to FIG. 2, that is the schematic drawing to operate the automatic decompression device shown in FIG. 1. Two lower arms 21 contact the cam surface 111 of the decompression device 10. There is a pushrod 22 connected with each lower arm 21. The upper end of each pushrod 22 is connected to an upper arm 23 which is hinged to the engine with a seat 25. In addition, an intake valve 20 and an exhaust valve 24 are fixed to the ends of the upper arms 23 away from pushrods 22. When the engine is working, the cam gear 111 is rotated and, consequently, the lower arms 21 are cyclically moved left and right since the lower arms 21 contact the cam surface 111. The motions of the lower arms 21 repeatedly drive the pushrods 22 to push and pull the upper arms 23, and then the intake valve 20 and the exhaust valve 24 are repeatedly opened and closed. When the engine just begins to be started up, the cam gear 11 is rotated slowly.

At this time, since the centrifugal forces induced by rotation are too small to act on the counterweight 12 against the spring forces generated by the spring 15, the half cylinder 13 is projected radially outwardly from the cam surface 111 through the recess 112. This biases the opening and closing duty cycles of both valves 20 and 24, and then the function of the automatic decompression device is enabled, i.e., the pressure of the engine's combustion chamber is thus partially released to make manually starting the engine up easily achievable. As the engine's speed is relatively high, the centrifugal forces induced by rotation are large enough to act on the counterweight 12 against the spring forces generated by the spring 15. Consequently, the counterweight 12 is moved radially outwardly, and the rotation device 13 is thus rotated by the counterweight 12 because the pin 132 of the rotation device 13 is guided by the guide slot 121 of the counterweight 12. Now, the circular surface 133 of the half cylinder 13 is rotated to face to the inside of the cam gear 11. This makes the opening and closing duty cycles of both valves 20 and 24 normal. In other words, the function of the automatic decompression device is not enabled.

A major problem of the automatic decompression device of the prior art is that the rotation device, the spring, and the counterweight must be assembled and pressed to the cam gear by the plate cover to guarantee its normal operation. Another problem is that the operation and structure of the rotation device of the prior art are complex.

The above problems induce high cost, more complicated design, fabrication, and assembly of the automatic decompression device of the prior art. The present inventor recognized the need for providing an automatic decompression device whose design, fabrication, and assembly can be simplified, and its costs can be down.

SUMMARY OF THE INVENTION

With the problems of the prior art in mind, an automatic decompression device of the invention comprises a cam gear with a recess, a counterweight, a spring, and an acting body. The spring and the counterweight are mounted to the cam gear, and the acting body is movable but is guided by the counterweight. The size of the recess of the cam gear is large enough to contain the acting body. When the automatic decompression device of the invention is static or slowly rotated, the acting body is moved upwardly into the recess to bias the opening and closing duty cycles of the engine's intake and exhaust valves of the present invention. Consequently, the function of the automatic decompression device is enabled, i.e., the pressure of the engine's combustion chamber is thus partially released to make manually starting the engine up easily achievable. When the automatic decompression device is rotated at a relatively high speed, the centrifugal forces induced by rotation are large enough to act on the counterweight against the spring forces generated by the spring. At this time, the acting body is moved downward by the counterweight to make the engine's intake and exhaust valves working normally. The automatic decompression device of the invention completely achieves the objective of decompression devices or engines.

One objective of the invention is to provide an automatic decompression device whose acting body is moved upwardly or downwards by the counterweight. It is noted that the structure of the acting body of the invention is simpler than the structure of the rotation device of the prior art.

Another objective of the invention is to provide an automatic decompression device without any plate cover for assembling and pressing the spring, the counterweight, and the acting body to the cam gear in order to guarantee its normal operation.

The other objective of the invention is to provide an automatic decompression device whose counterweight is translated but not rotated by the centrifugal forces induced by rotation.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DETAILED DESCRIPTION OF THE INVENTION

The First Embodiment

Figure 1:
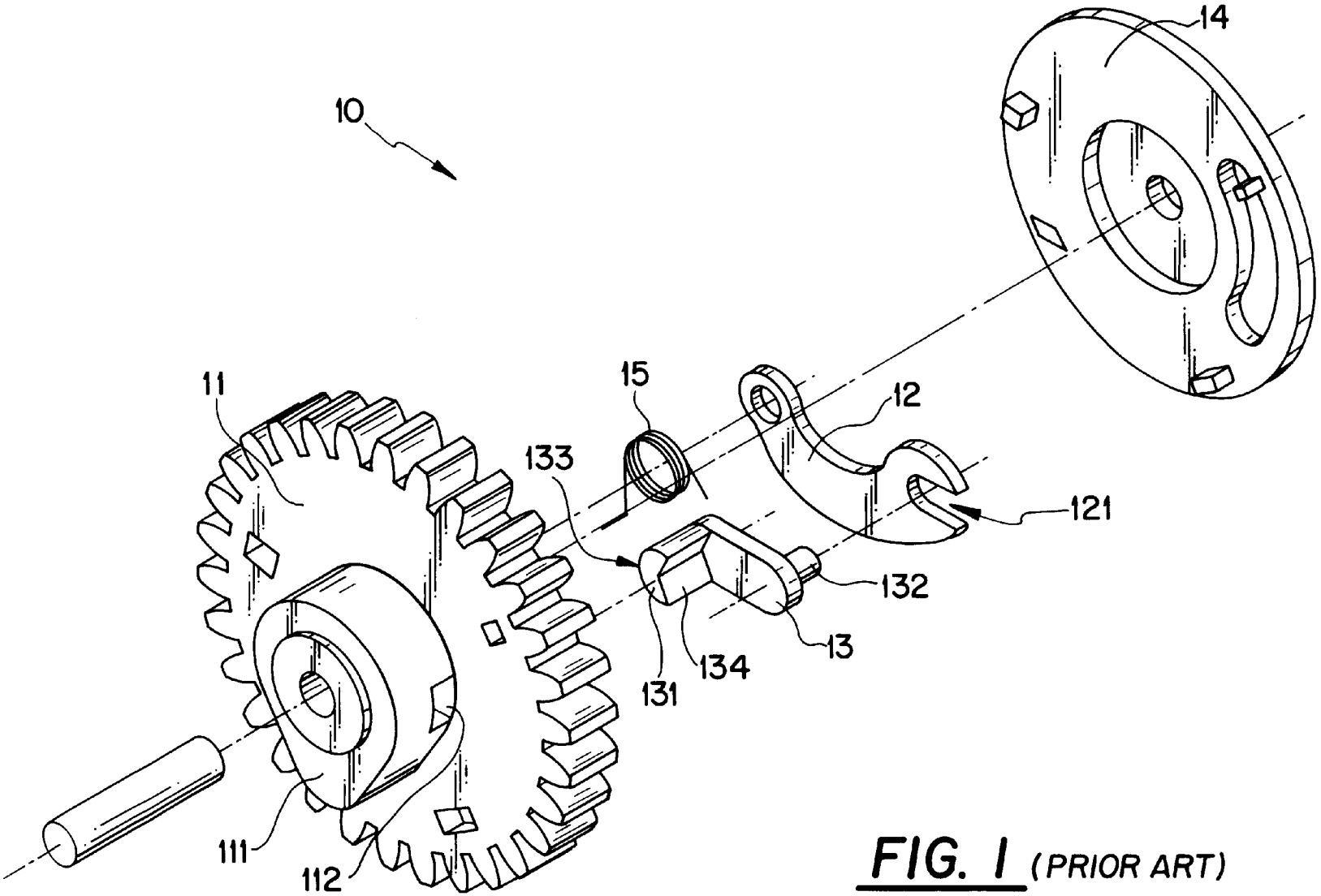
FIG. 1 (PRIOR ART)
FIG. 1 is the exploded perspective view of an automatic decompression device of the prior art.
Figure 2:
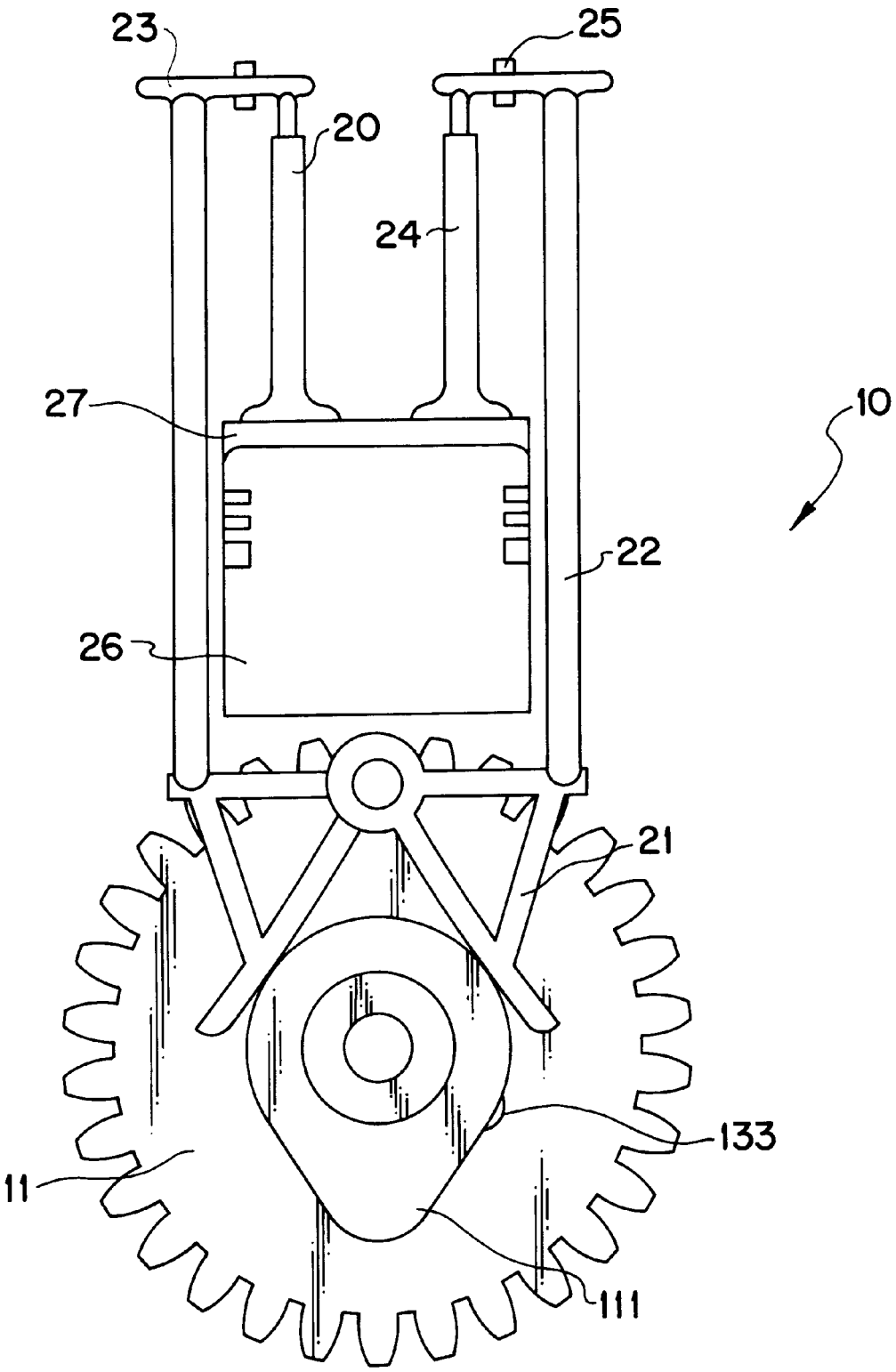
FIG. 2 is the schematic diagram showing the operation of automatic decompression devices.
Figure 3:
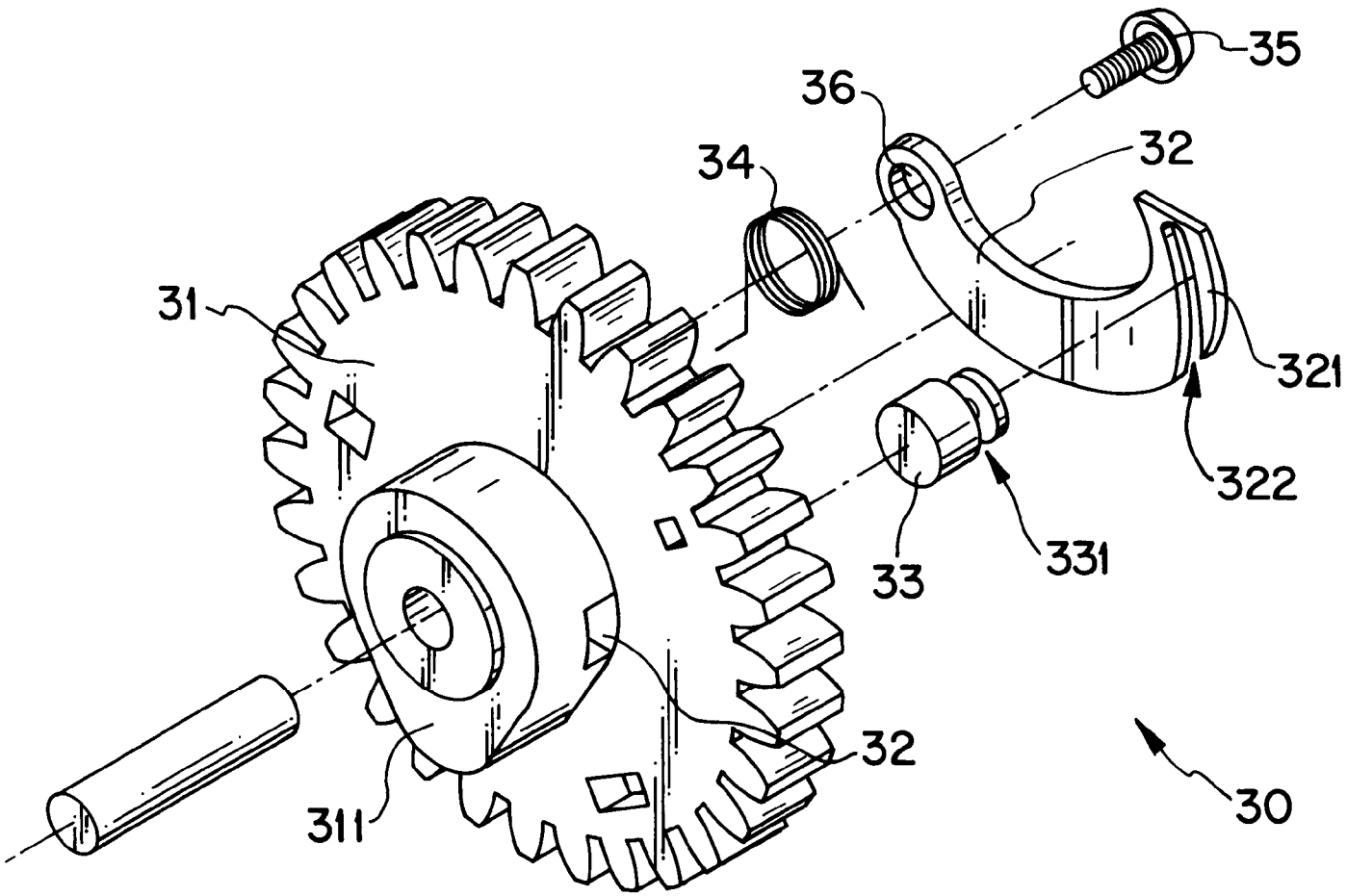
FIG. 3 is the exploded perspective view of an automatic decompression device of the invention.
Figure 4A:
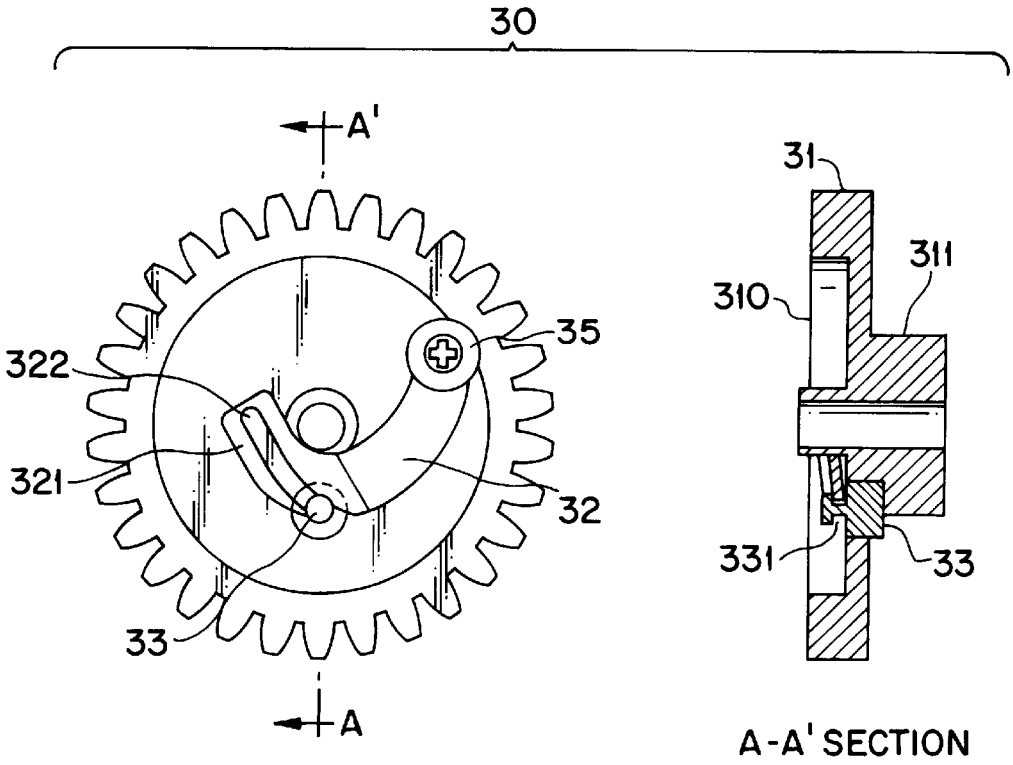
FIG. 4A is the cross-section view of the automatic decompression device shown in FIG. 3 when the engine of the invention is static.
Figure 4B:
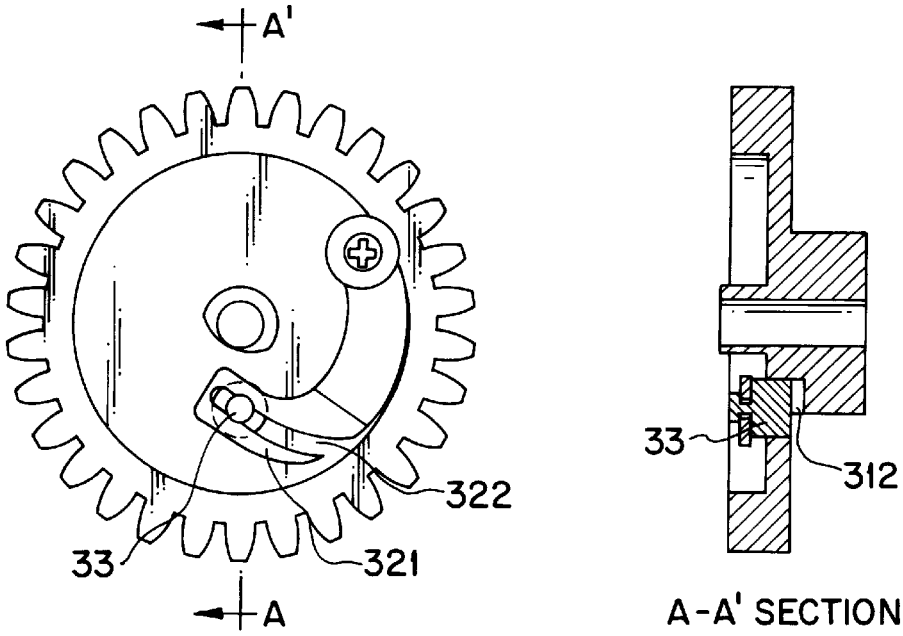
FIG. 4B is the cross-section view of the automatic decompression device shown in FIG. 3 when the engine of the invention is rotated at a relatively high speed.

Please refer to FIG. 3, which is the exploded perspective view of an automatic decompression device of the invention. The automatic decompression device 30 of the invention comprises a cam gear 31, a counterweight 32, an acting body 33, and a spring 34. The cam gear 31 includes a cam surface 311 at its top, and a recess 312 at its bottom, where the recess 312 pierces the cam surface 311. The size of the recess 312 is large enough to contain the acting body 33. Please refer to FIGS. 4A and 4B, which are the cross-section views of the automatic decompression at different status of the engine of the invention. At the side without the cam surface 311 of the cam gear 31, there is a valley 310 including a countersink 36. The counterweight 32 and the spring 34 are mounted to the valley 310 by screwing a bolt 35 into the countersink 36. The counterweight 32 is rotary but forced by the spring 34. At the end of the counterweight 32 apart from the bolt 35, the counterweight 32 comprises a plate 321 with an incline surface. In the plate 321, there is a guide slot 322. The acting body 33 is a cylinder which has a neck 331 and whose cross section is I-shape. The neck 331 of the acting body 33 and the guide slot 322 of the counterweight 32 are engaged at any time, the motion of the acting body 33 is consequently guided by the counterweight 32. When the engine of the invention is static, the acting body 33 is moved upwardly into the recess 312 by the counterweight 32 since the spring 34 gives spring forces on the counterweight 32. Hence, part of the acting body 33 is exposed beyond the cam surface 311 to bias the opening and closing duty cycles of the intake valve 20 and the exhaust valve 24. It causes the function of the automatic decompression device 30 being enabled, i.e., the pressure of the engine's combustion chamber is thus partially released to make manually starting the engine up easily achievable. When the engine of the invention is rotated at a relatively high speed, the centrifugal forces induced by rotation are large enough to act on the counterweight 32 against the spring forces generated by the spring 34. At this time, the counterweight 32 is rotated outwardly and the acting body 33 is moved down the incline surface of the plate 321 with the guidance of the guide slot 322. Hence, the acting body 33 is tucked into the cam gear 31, and the cam surface 311 is remitted. This makes the opening and closing duty cycles of both valves 20 and 24 normal. In other words, the function of the automatic decompression device 30 is not enabled. When the engine of the invention is shut down, the spring forces generated by the spring 34 act on the counterweight 32 against the centrifugal forces to rotate the counterweight 32 to the normal status. At this time, the acting body 33 is moved upwardly into the recess 312 again to bias the opening and closing duty cycles of the intake valve 20 and the exhaust valve 24.

With the present embodiment of the invention, the acting body 33 is moved upwardly and downwards by the counterweight 32, and the automatic decompression device 30 does not need any plate cover to assemble the cam gear 31, the counterweight 32, the acting body 33, and the spring 34. Hence, the design, fabrication, and assembly of the automatic decompression device 30 are simplified, and its price is cost down.

The Second Embodiment

Figure 5:
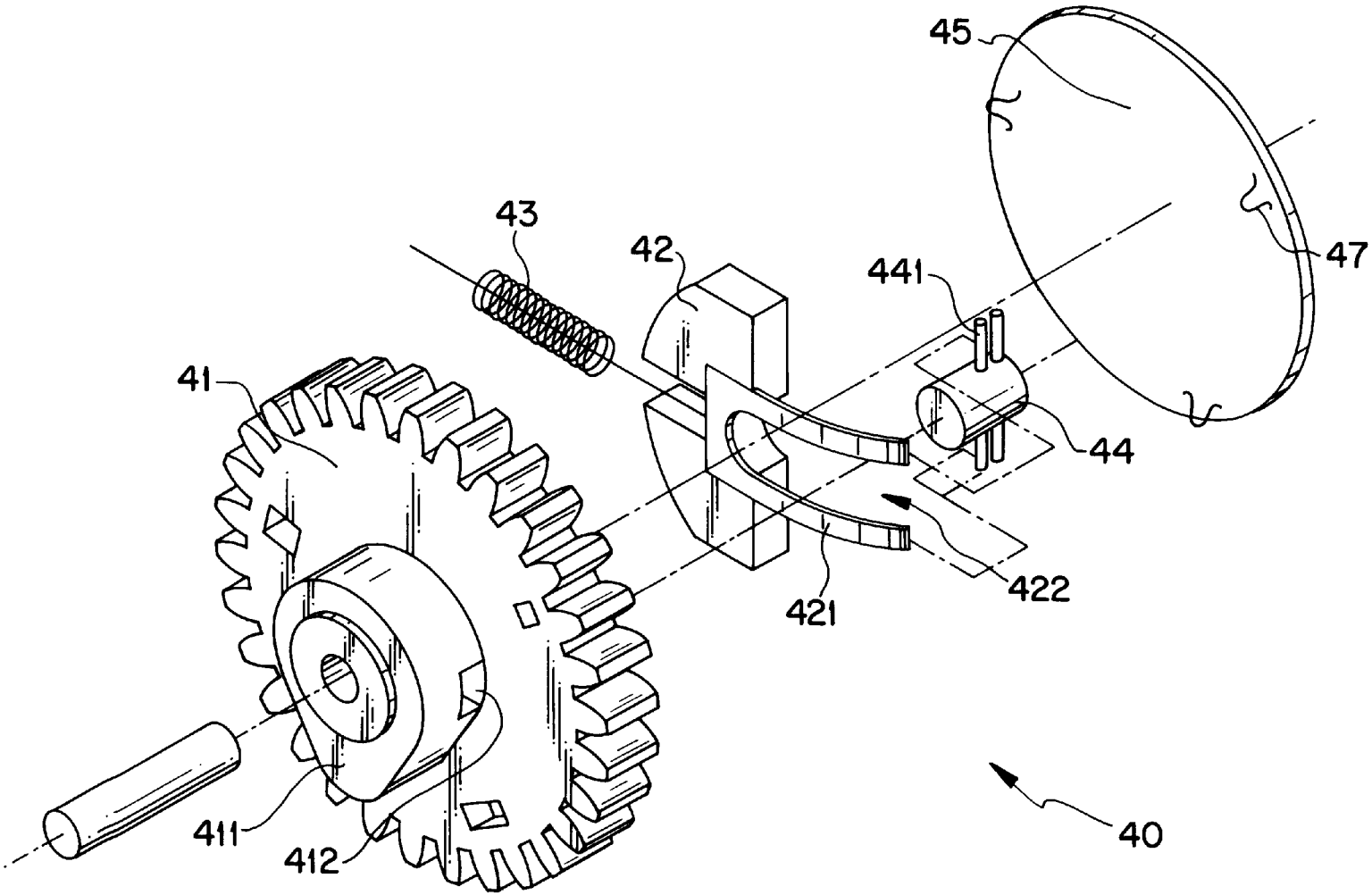
FIG. 5 is the exploded perspective view of another automatic decompression device of the invention.
Figure 6A:
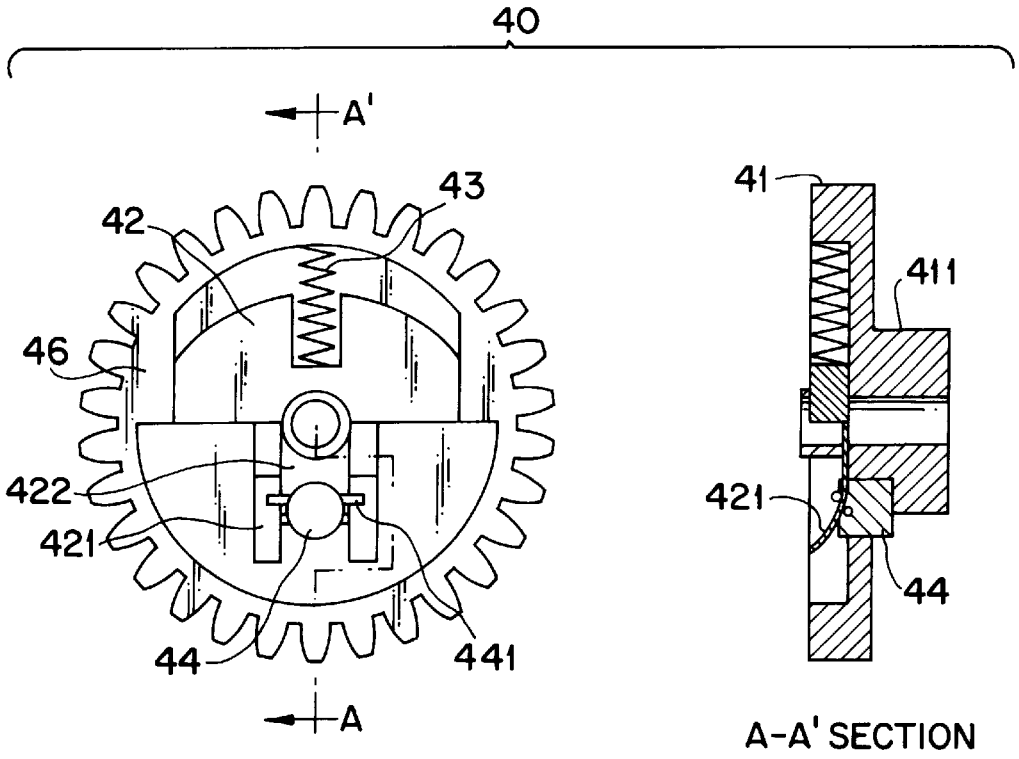
FIG. 6A is the cross-section view of the automatic decompression device shown in FIG. 5 when the engine of the invention is static.
Figure 6B:
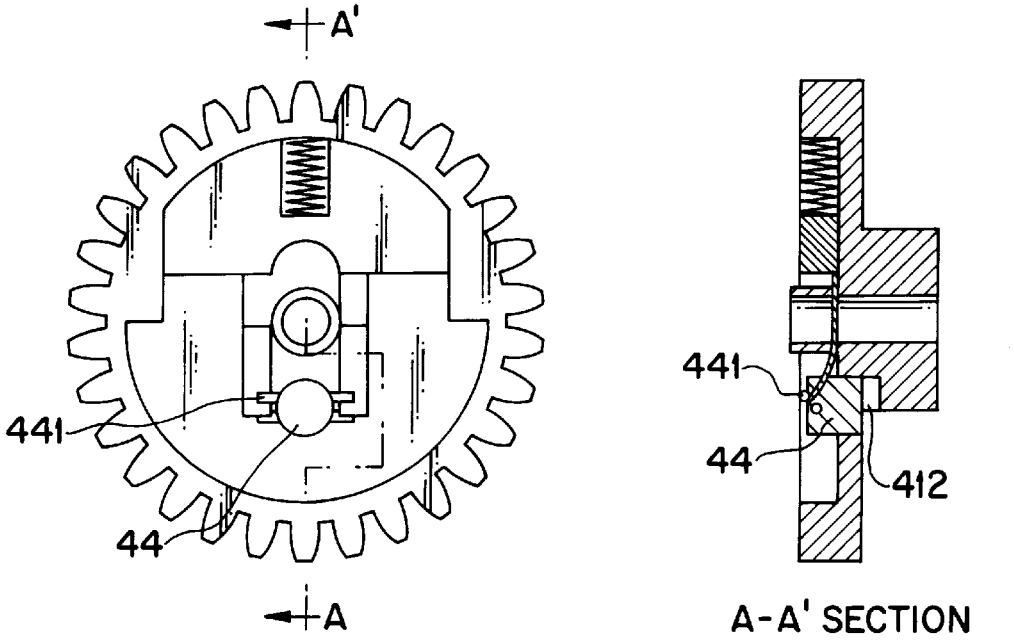
FIG. 6B is the cross-section view of the automatic decompression device shown in FIG. 5 when the engine of the invention is rotated at a relatively high speed.

Please refer to FIG. 5, which is the exploded perspective view of another automatic decompression device of the invention. The automatic decompression device 40 of the invention comprises a cam gear 41, a counterweight 42, a spring 43, an acting body 44, and a plate cover 45. The cam gear 41 includes a cam surface 411 at the top of the cam gear 41, a stopper 46 at each side, a recess 412 as the bottom, and three through holes 413, where the recess 412 pierces the cam surface 411. The size of the recess 412 is large enough to contain the acting body 44. The plate cover 45 includes three spring rings 47 located at the corresponding positions of the holes 413 of the cam gear 41. Please refer to FIGS. 6A and 6B, which are the cross-section views of the automatic decompression at different status of the engine of the invention. At the side without the cam surface 411 of the cam gear 41, there is a valley where the counterweight 42 and the spring 43 are located. The counterweight 42 and the spring 43 are mounted to the valley by engaging the spring rings 47 of the plate cover 45 into the holes 413 of the cam gear 41. The counterweight 42 is movable but forced by the spring 43 and limited by the stoppers 46. At the end of the counterweight 42 apart from the spring 43, the counterweight 42 comprises a curved plate 421. In the curved plate 421, there is a guide slot 422. The acting body 44 is a cylinder with two guide rods 441. The acting body 44 locates inside the guide slot 422, and the curved plate 421 locates between the guide rods 441 of the acting body 44. Hence, the motion of the acting body 44 is consequently guided by the counterweight 42. When the engine of the invention is static, the acting body 44 is moved upwardly into the recess 412 by the counterweight 42 since the spring 43 gives spring forces on the counterweight 42. Hence, part of the acting body 44 is exposed beyond the cam surface 411 to bias the opening and closing duty cycles of the intake valve 20 and the exhaust valve 24. It causes the function of the automatic decompression device 40 being enabled, i.e., the pressure of the engine's combustion chamber is thus partially released to make manually starting the engine up easily achievable. When the engine of the invention is rotated at a relatively high speed, the centrifugal forces induced by rotation are large enough to act on the counterweight 42 against the spring forces generated by the spring 43. At this time, the counterweight 42 is linearly moved in radial direction and the acting body 44 is moved down the curved plate 421 with the guidance of the guide slot 422. Hence, the acting body 44 is tucked into the cam gear 41, and the cam surface 411 is remitted. This makes the opening and closing duty cycles of both valves 20 and 24 normal. In other words, the function of the automatic decompression device 40 is not enabled. When the engine of the invention is shut down, the spring forces generated by the spring 43 act on the counterweight 9 against the centrifugal forces to radially move the counterweight 42 to the normal status. At this time, the acting body 44 is moved upwardly into the recess 412 again to bias the opening and closing duty cycles of the intake valve 20 and the exhaust valve 24.

With the present embodiment of the invention, the acting body 44 is moved upwardly and downwards by the counterweight 42, and the counterweight 42 is linearly moved in radial direction by the centrifugal forces. The automatic decompression device 40 simplifies the mechanism of the counterweight of the prior art.

Another Embodiment

Figure 7A:
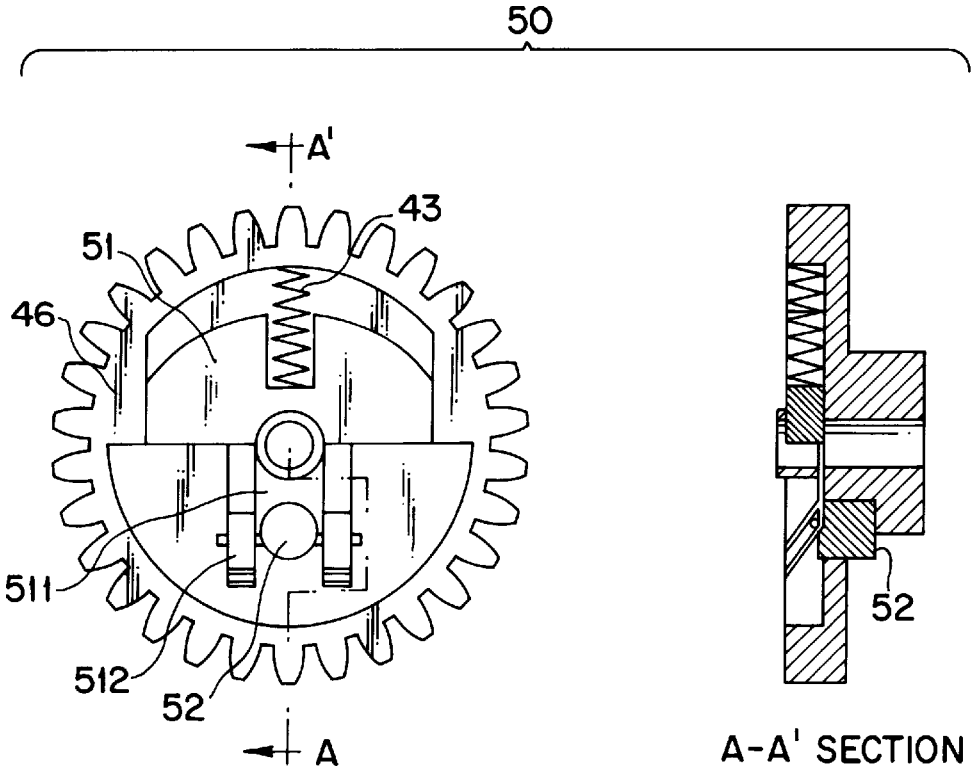
FIGS. 7A and 7B is the cross-section view of another preferred embodiment of the automatic decompression device shown in FIG. 5 when the engine of the invention is operated at two status.
Figure 7B:
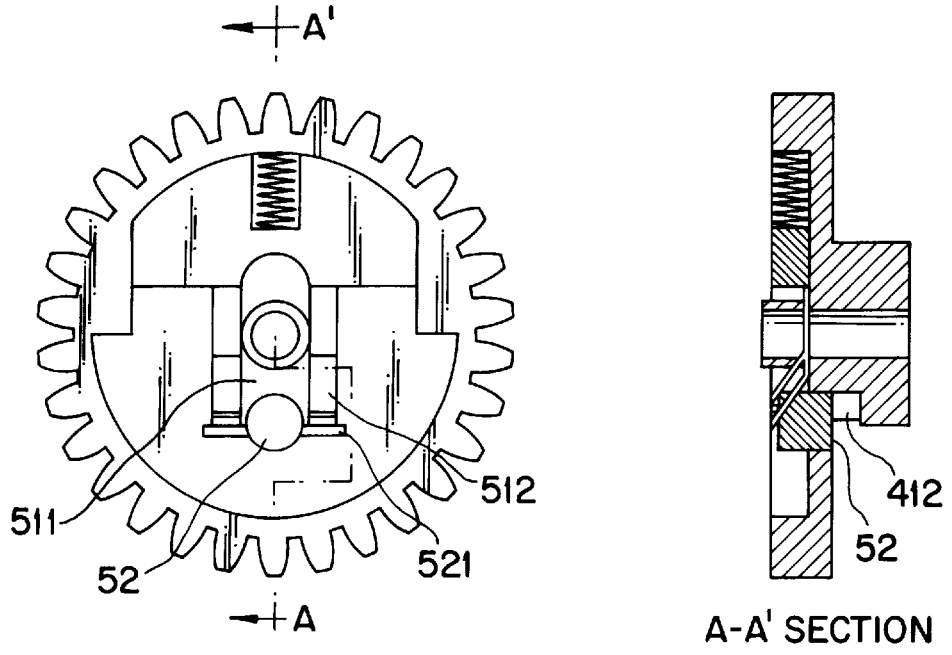

Please refer to FIGS. 7A and 7B, which presents another preferred embodiment of the automatic decompression device shown in FIG. 5. The automatic decompression device 50 of the present embodiment counterweight 51 and an acting body 52. At the end of the counterweight 51 apart from the spring 43, there is a plate 511 including a slashed end. In the plate 511, there is a guide slot 512. The acting body 52 is a cylinder with a guide rod 521. The guide rod 521 is inserted between the slashed end of the plate 511, and the acting body 52 is limited by the guide slot 512. In the normal status, the counterweight 51 is forced by the spring 43 to move the acting body 52 upwardly into the recess 412. Hence, part of the acting body 52 is exposed beyond the cam surface 411 to bias the opening and closing duty cycles of the intake valve 20 and the exhaust valve 24. It causes the function of the automatic decompression device 50 being enabled, i.e., the pressure of the engine's combustion chamber is thus partially released to make manually starting the engine up easily achievable. When the engine of the invention is rotated at a relatively high speed, the centrifugal forces induced by rotation are large enough to act on the counterweight 51 against the spring forces generated by the spring 43. At this time, the counterweight 51 is linearly moved in radial direction and the acting body 52 is moved down the plate 511 with the guidance of the guide slot 512 guide slot 512 and the slashed end. Hence, the acting body 52 is tucked into the cam gear 41, and the cam surface 411 is remitted. This makes the opening and closing duty cycles of both valves 20 and 24 normal. In other words, the function of the automatic decompression device 50 is not enabled.

Further Embodiment

Figure 8A:
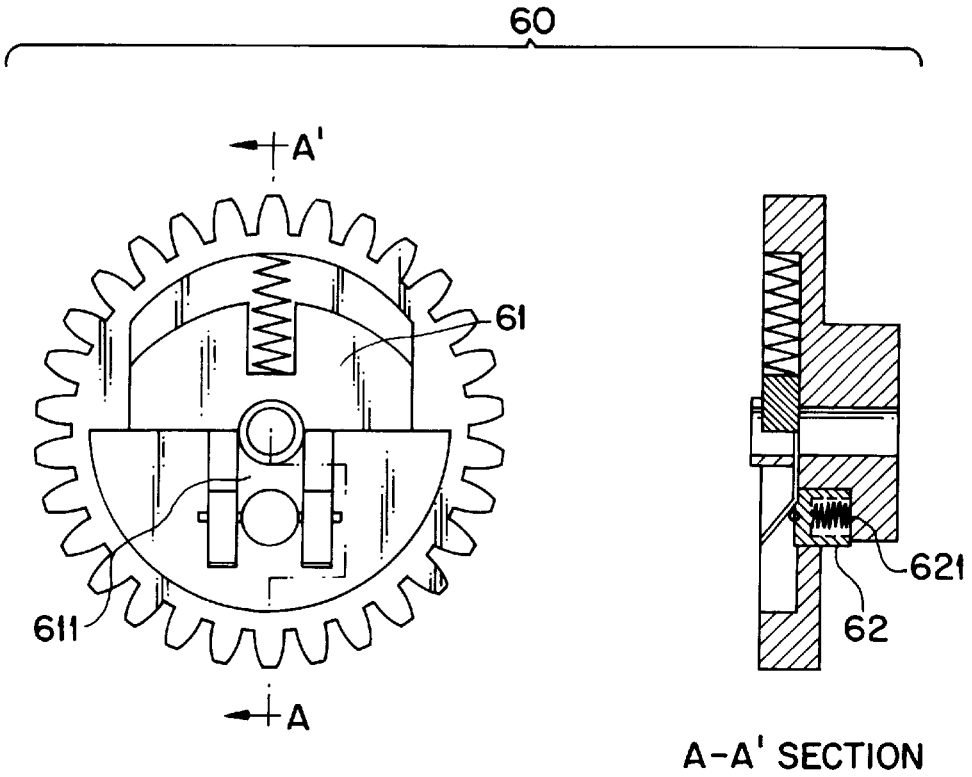
FIGS. 8A and 8B is the cross-section view of a further preferred embodiment of the automatic decompression device shown in FIG. 5 when the engine of the invention is operated at two status.
Figure 8B:
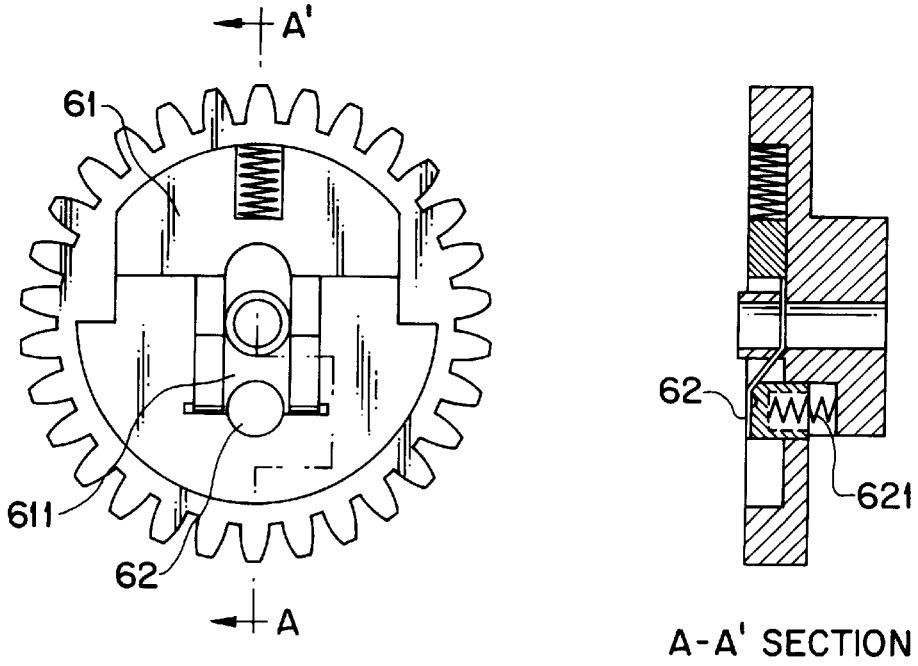

Please refer to FIGS. 8A and 8B, which presents a further preferred embodiment of the automatic decompression device shown in FIG. 5. The automatic decompression device 60 of the present embodiment comprises a counterweight 61 and an acting body 62. At the end of the counterweight 61 apart from the spring 43, there is an incline plate 611 including a guide slot. The acting body 62 comprises a cylinder with a guide rod and a valley on its top, and a pressed spring 621 located in the valley of the cylinder. The guide rod of the acting body 62 locates upon the plate 611, and the acting body 62 is limited by the guide slot of the counterweight 61. In the normal status, the counterweight 61 is forced by the spring 43 against the spring forces of the pressed spring 621 to move the acting body 62 upwardly into the recess 412. Hence, part of the acting body 62 is the cam surface 411 to bias the opening and closing duty cycles of the intake valve 20 and the exhaust valve 24. It causes the function of the automatic decompression device 60 being enabled, i.e., the pressure of the engine's combustion chamber is thus partially released to make manually starting the engine up easily achievable. When the engine of the invention is rotated at a relatively high speed, the centrifugal forces induced by rotation are large enough to act on the counterweight 61 against the spring forces generated by the spring 43. At this time, the counterweight 61 is linearly moved in radial direction, and, by the spring forces of the pressed spring 621, the acting body 62 is pressed down the plate 611 with the guidance of the guide slot of the counterweight 61. Hence, the acting body 62 is tucked into the cam gear 41, and the cam surface 411 is remitted. This makes the opening and closing duty cycles of both valves 20 and 24 normal. In other words, the function of the automatic decompression device 60 is not enabled.

In the last two embodiments of the invention, the acting body is moved upwardly and downwards by the counterweight or the pressed spring, and the counterweight is linearly moved in radial direction by the centrifugal forces. The two automatic decompression devices indeed simplify the mechanism of the counterweight of the prior art.

It is noted that the automatic decompression devices for engines described above are the preferred embodiments of the present invention for the purposes of illustration only, and are not intended as a definition of the limits and scope of the invention disclosed. Any modifications and variations that may be apparent to a person skilled in the art are intended to be included within the scope of the present invention.

What is claimed is:

1. An automatic decompression device of engines comprising:

a cam gear, including a cam surface on one side, a recess and a valley on the other side, said recess piercing said cam surface;

a counterweight with a spring connected to one end of said counterweight, including a plate with an inclined surface and a guide slot at the end of said counterweight apart from said spring, said spring and said counterweight located in said valley of said cam gear; and an acting body, located at the side of said cam gear apart from said cam surface, one end of said acting body located inside said recess and the other end of said acting body projected outside the side of said cam gear apart from said cam surface, the projected end of said acting body engaged to said guide slot, moved upwardly or downwards in said recess.

2. The automatic decompression device of engines as claimed in claim 1 wherein the end of said counterweight connected to said spring is mounted to said cam gear with a bolt.

3. The automatic decompression device of engines as claimed in claim 1 wherein said counterweight moves said acting body upwardly or downwards as said cam gear is rotated.

4. The automatic decompression device of engines as claimed in claim 1 wherein said acting body is I-shape and includes a neck engaged to said guide slot.

5. The automatic decompression device of engines as claimed in claim 4 wherein said cam gear comprises two stoppers at two sides of said valley for limiting said counterweight.

6. The automatic decompression device of engines as claimed in claim 5 wherein said plate includes a slashed end.

7. The automatic decompression device or engines as claimed in claim 5 wherein said automatic decompression device comprises a cover for assembling and mounting said counterweight and said acting body to said cam gear.

8. An automatic decompression device of engines comprising:

a cam gear, including a cam surface on one side, a recess and a valley on the other side, said recess piercing said cam surface;

a counterweight with a spring connected to one end of said counterweight, said spring and said counterweight located in said valley of said cam gear, including a plate with an inclined surface and a guide slot at the end of said counterweight apart from said spring; and an acting body, including two guide rods, located at the side of said cam gear apart from said cam surface, one end of said acting body located inside said recess and the other end of said acting body projected outside the side of said cam gear apart from said cam surface, said guide rods located outside said recess, said plate of said counterweight inserted between said guide rods, the projected end of said acting body engaged to said guide slot, moved upwardly or downwards in said recess.

9. The automatic decompression device of engines as claimed in claim 8 wherein said plate includes a slashed end.

10. The automatic decompression device of engines as claimed in claim 9 wherein said acting body includes a guide rod at the projected end of said acting body.

11. The automatic decompression device of engines as claimed in claim 10 wherein said acting body includes a pressed spring at the end of said acting body inside said recess.

12. The automatic decompression device of engines as claimed in claim 8 wherein said automatic decompression device comprises a cover for assembling and mounting said counterweight and said acting body to said cam gear.

13. The automatic decompression device of engines as claimed in claim 12 wherein said cover is mounted to the side of said cam gear apart from said cam surface with bolts or spring rings.

* * * * *